US011963628B2

(12) United States Patent
Chen

(10) Patent No.: US 11,963,628 B2
(45) Date of Patent: Apr. 23, 2024

(54) PILLOW

(71) Applicant: PLESON (HK) TECHNOLOGY LIMITED, Hong Kong (HK)

(72) Inventor: Xin Chen, Hong Kong (HK)

(73) Assignee: PLESON (HK) TECHNOLOGY LIMITED, Hong Kong (HK)

( * ) Notice: Subject to any disclaimer, the term of this patent is extended or adjusted under 35 U.S.C. 154(b) by 0 days.

(21) Appl. No.: 18/463,377

(22) Filed: Sep. 8, 2023

(65) Prior Publication Data

US 2023/0414016 A1 Dec. 28, 2023

(30) Foreign Application Priority Data

Aug. 10, 2023 (CN) ..... 202322146392.X

(51) Int. Cl.

*A47G 9/10* (2006.01)
*A47C 7/38* (2006.01)
*A47C 20/02* (2006.01)

(52) U.S. Cl.

CPC ..... *A47G 9/1063* (2013.01); *A47C 7/383* (2013.01); *A47C 20/02* (2013.01); *A47G 9/1054* (2013.01); *A47C 7/38* (2013.01); *A47G 9/10* (2013.01)

(58) Field of Classification Search

CPC ..... A47G 9/1063; A47G 9/1054; A47G 9/10; A47C 7/38; A47C 7/383; A47C 20/00; A47C 20/02

USPC ..... 5/638, 636, 632, 639, 646, 630

See application file for complete search history.

(56) References Cited

U.S. PATENT DOCUMENTS 3,883,906 A * 5/1975 Sumpter ..... A47G 9/1063 5/636
4,042,988 A * 8/1977 Holliday ..... A47C 27/081 5/691
5,148,564 A * 9/1992 Reder ..... A47G 9/10 5/636
5,557,813 A * 9/1996 Steed ..... A47C 27/081 5/717
5,579,551 A * 12/1996 Tommaney ..... A47G 9/1009 5/636
5,604,944 A * 2/1997 Meade ..... A47G 9/1009 5/636
5,644,809 A * 7/1997 Olson ..... A47G 9/1081 5/639
6,041,458 A * 3/2000 Vickers ..... A47G 9/10 5/636
6,079,066 A * 6/2000 Backlund ..... A47G 9/10 5/636
6,336,236 B1 * 1/2002 Dalton ..... A47G 9/10 5/636
6,581,226 B1 * 6/2003 Brustein ..... A47G 9/1063 5/636

(Continued)

*Primary Examiner* — Robert G Santos
(74) *Attorney, Agent, or Firm* — Zhigang Ma

(57) ABSTRACT

The present disclosure discloses a pillow. The pillow includes a first pillow body and a second pillow body. The first pillow body is stacked on the second pillow body. The first pillow body and the second pillow body are connected to form a channel. So that when a user can take a rest on a desk with the pillow, the user lets the arms pass through the channel. The first pillow body and the second pillow body support the arms above and below the arms, so that a pressure on the arms can be reduced. Meanwhile, the head is placed on the pillow, which can improve the sleep experience.

15 Claims, 6 Drawing Sheets

(56) References Cited

U.S. PATENT DOCUMENTS 6,671,907 B1 * 1/2004 Zuberi ..... A47G 9/1063 5/636
7,017,215 B1 * 3/2006 Singer ..... A61G 13/12 5/646
7,216,387 B2 * 5/2007 Laxton ..... A47G 9/1009 5/636
7,228,580 B2 * 6/2007 Dalton ..... A47G 9/10 5/639
7,441,293 B1 * 10/2008 Singer ..... A47C 20/023 5/632
8,069,515 B1 * 12/2011 Tingey ..... A47G 9/10 5/636
8,176,586 B2 * 5/2012 Berke ..... A47G 9/1081 5/639
8,756,734 B1 * 6/2014 Ortega ..... A47G 9/10 5/636
8,910,330 B1 * 12/2014 Malik ..... A47G 9/109 5/636
8,997,285 B2 * 4/2015 Moore ..... A61F 5/56 5/636
9,167,922 B1 * 10/2015 Holbrook ..... A47G 9/10
9,974,400 B2 * 5/2018 Zuber ..... A47G 9/1063
D828,700 S * 9/2018 Jhunjhnuwala ..... D6/601
2005/0138733 A1 * 6/2005 Riesberg ..... A47G 9/10 5/636
2006/0200908 A1 * 9/2006 Dalton ..... A47G 9/10 5/655
2006/0236459 A1 10/2006 Lavin et al.
2006/0282952 A1 * 12/2006 Laxton ..... A47G 9/1009 5/636
2010/0229307 A1 9/2010 Sato
2010/0242179 A1 * 9/2010 Berke ..... A47G 9/10 5/636
2011/0296615 A1 * 12/2011 Tingey ..... A47C 20/023 5/632
2012/0017374 A1 1/2012 Hunter et al.
2015/0040321 A1 * 2/2015 Moore ..... A47G 9/10 5/636
2016/0157644 A1 * 6/2016 Holbrook ..... A47G 9/10 5/490
2017/0245665 A1 * 8/2017 Zuber ..... A47G 9/1063
2023/0347203 A1 * 11/2023 Morris ..... A63B 21/4035
2023/0414016 A1 * 12/2023 Chen ..... A47C 16/00

* cited by examiner

PILLOW

CROSS-REFERENCE TO RELATED APPLICATIONS

The application claims priority of Chinese patent application CN202322146392.X, filed on Aug. 10, 2023, which is incorporated herein by reference in its entireties.

TECHNICAL FIELD

The present disclosure relates to a sleep tool, and in particular to, a pillow.

BACKGROUND

In today's life, due to high learning and working burden on most people, people cannot take a good rest. Furthermore, there is a limited rest space in learning and working places, and most people can only choose to take a rest on desks. If people directly place their heads on their arms, a pressure would be caused on the arms, and even they would feel numb in the arms, which affects the rest.

At present, there are various nap pillows available on the market to solve this problem, but most of them occupy a large space and have relatively single functional forms, which cannot meet various usage scenarios.

SUMMARY

In view of this, the present disclosure provides a pillow that can be used in various scenarios.

The present disclosure discloses a pillow including a first pillow body and a second pillow body, wherein the first pillow body is stacked on the second pillow body; and the first pillow body and the second pillow body are connected to form a channel.

Further, the first pillow body is divided into a first portion, a second portion, and a third portion; the second portion is arranged between the first portion and the third portion; the second pillow body is divided into a fourth portion, a fifth portion, and a sixth portion; the fifth portion is arranged between the fourth portion and the sixth portion; and a first edge of the second portion is connected to a third edge of the fifth portion, and a second edge of the second portion is connected to a fourth edge of the fifth portion, so as to form the channel.

Further, the first pillow body includes a first pillowcase, a first pillow interior, and a first opening; the first pillowcase forms a first cavity by connecting a first face to a second face; and the first pillow interior is arranged in the first pillowcase through the first opening.

Further, the second face is composed of a first surface and a second surface; a fifth edge of the first surface is arranged above or below a sixth edge of the second surface to form the first opening.

Further, the first pillow interior includes a first pillow interior cover and a first filler; and the first filler is arranged in the pillow interior cover.

Further, the second pillow body includes a second pillowcase, a second pillow interior, and a second opening; the second pillowcase forms a second cavity by an upper side wall, a side wall, and a lower side wall; and the second pillow interior is arranged in the second pillowcase through the second opening.

Further, the second opening is arranged at a connection between the upper side wall and the side wall of the second pillowcase.

Further, the side wall is composed of a plurality of uniformly arranged mesh structures, and a surface of the lower side wall is divided into a plurality of uniform rhombic structures.

Further, the second pillow interior includes a second pillow interior cover and a second filler; and the second filler is arranged in the second pillow interior cover.

Further, a plurality of arc-shaped strip protrusions are arranged on an upper surface of the second filler, and a plurality of round holes are uniformly arranged on the second filler; and the round holes penetrate through the second filler.

Further, the first portion and the third portion of the first pillow body are able to be turned towards the second portion.

The present disclosure discloses a pillow including a first pillow body and a second pillow body, wherein the first pillow body is stacked on the second pillow body; two sides of the first pillow body and two sides of the second pillow body are connected to form a channel between the first pillow body and the second pillow body.

Further, the first pillow body is divided into a first portion, a second portion, and a third portion; the second portion is arranged between the first portion and the third portion; the second pillow body is divided into a fourth portion, a fifth portion, and a sixth portion; the fifth portion is arranged between the fourth portion and the sixth portion; and a first edge of the second portion is connected to a third edge of the fifth portion, and a second edge of the second portion is connected to a fourth edge of the fifth portion, so as to form the channel.

Further, the first pillow body includes a first pillowcase, a first pillow interior, and a first opening; the first pillowcase forms a first cavity by connecting a first face to a second face; and the first pillow interior is arranged in the first pillowcase through the first opening.

Further, the second face is composed of a first surface and a second surface; a fifth edge of the first surface is arranged above or below a sixth edge of the second surface to form the first opening; wherein the first pillow interior includes a first pillow interior cover and a first filler; and the first filler is arranged in the pillow interior cover.

Further, the second pillow body includes a second pillowcase, a second pillow interior, and a second opening; the second pillowcase forms a second cavity by an upper side wall, a side wall, and a lower side wall; and the second pillow interior is arranged in the second pillowcase through the second opening.

Further, the second opening is arranged at a connection between the upper side wall and the side wall of the second pillowcase; wherein the side wall is composed of a plurality of uniformly arranged mesh structures, and a surface of the lower side wall is divided into a plurality of uniform rhombic structures.

Further, the second pillow interior includes a second pillow interior cover and a second filler; and the second filler is arranged in the second pillow interior cover.

Further, a plurality of arc-shaped strip protrusions are arranged on an upper surface of the second filler, and a plurality of round holes are uniformly arranged on the second filler; and the round holes penetrate through the second filler.

Further, the first portion and the third portion of the first pillow body are able to be turned towards the second portion.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

The accompanying drawings in the embodiment of the present disclosure are combined, The technical scheme in the embodiment of the present disclosure is clearly and completely described, Obviously, the described embodiment is only a part of the embodiment of the utility model, but not all embodiments are based on the embodiment of the utility model, and all other embodiments obtained by ordinary technicians in the field on the premise of not doing creative work belong to the protection range of the utility model.

In order to make the aims, technical solution and advantages of the present disclosure will be clearly, the present disclosure is further described below in combination with accompanying drawings and implementations.

The terms "first", "second", "first", and the like in the specification and claims of the present disclosure and the above drawings are used to distinguish similar objects, and are not intended to describe a specific sequence. In addition, the terms "include" and any variations thereof mean covering and non-exclusive inclusion. For example, processes, methods, systems, products, or devices which include a series of steps or units are not limited to listed steps or units, but selectively further include steps or units which are not listed, or selectively further include other steps or units which are inherent to these processes, methods, products, or devices.

Figure 1:
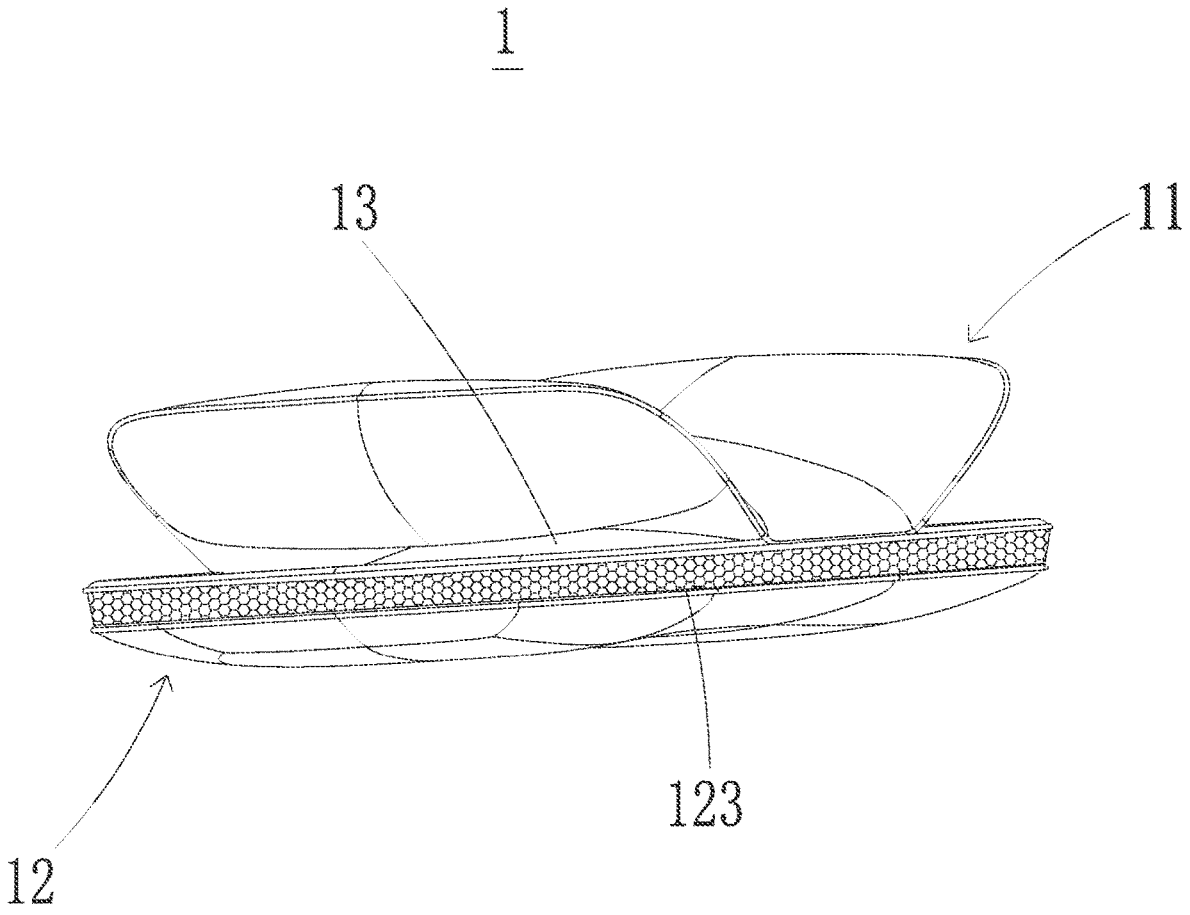
FIG. 1 is a schematic diagram of a three-dimensional structure of a pillow of the present disclosure.
Figure 2:
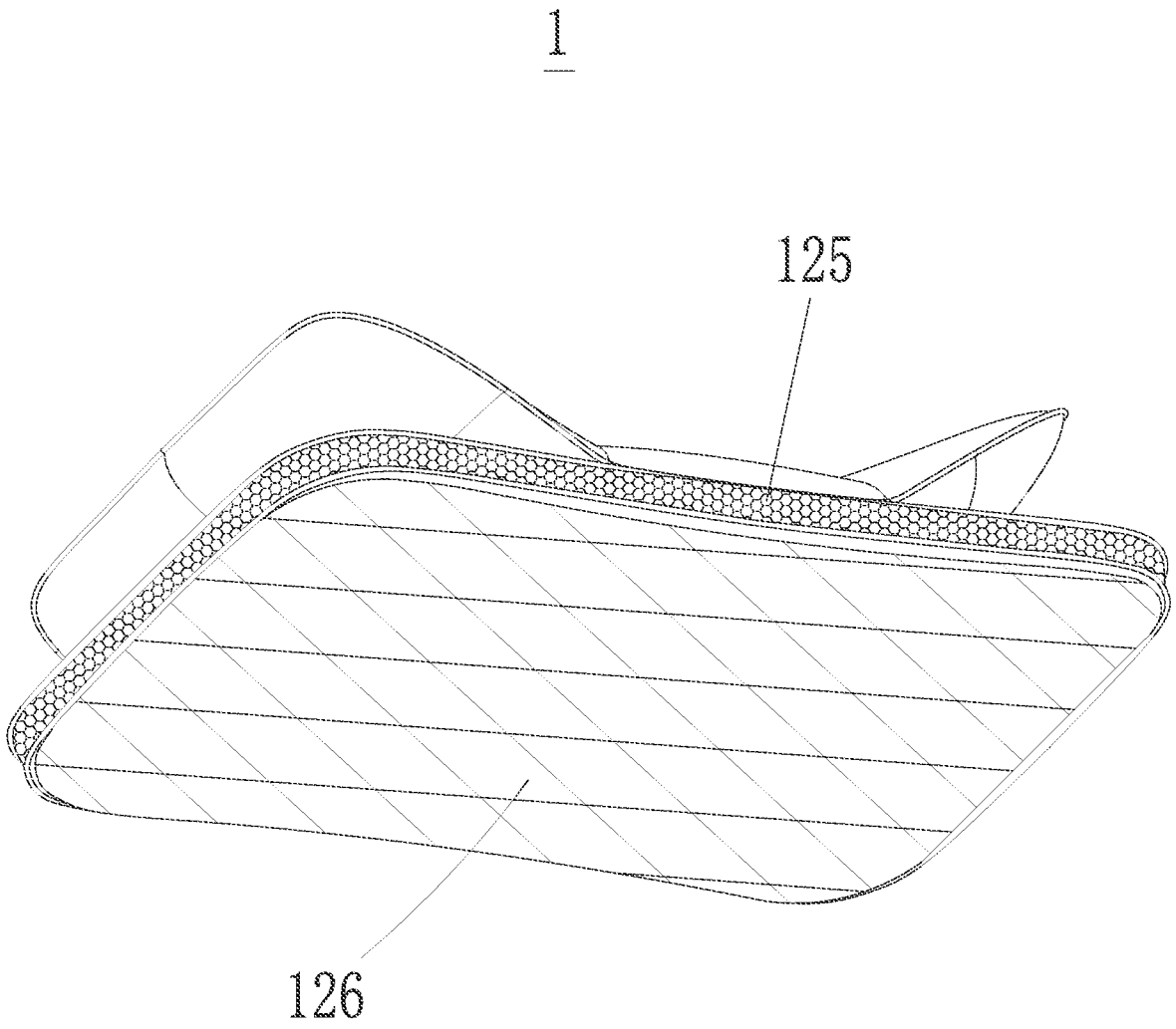
FIG. 2 is a schematic diagram of a three-dimensional structure of the pillow shown in FIG. 1 in another angle.
Figure 3:
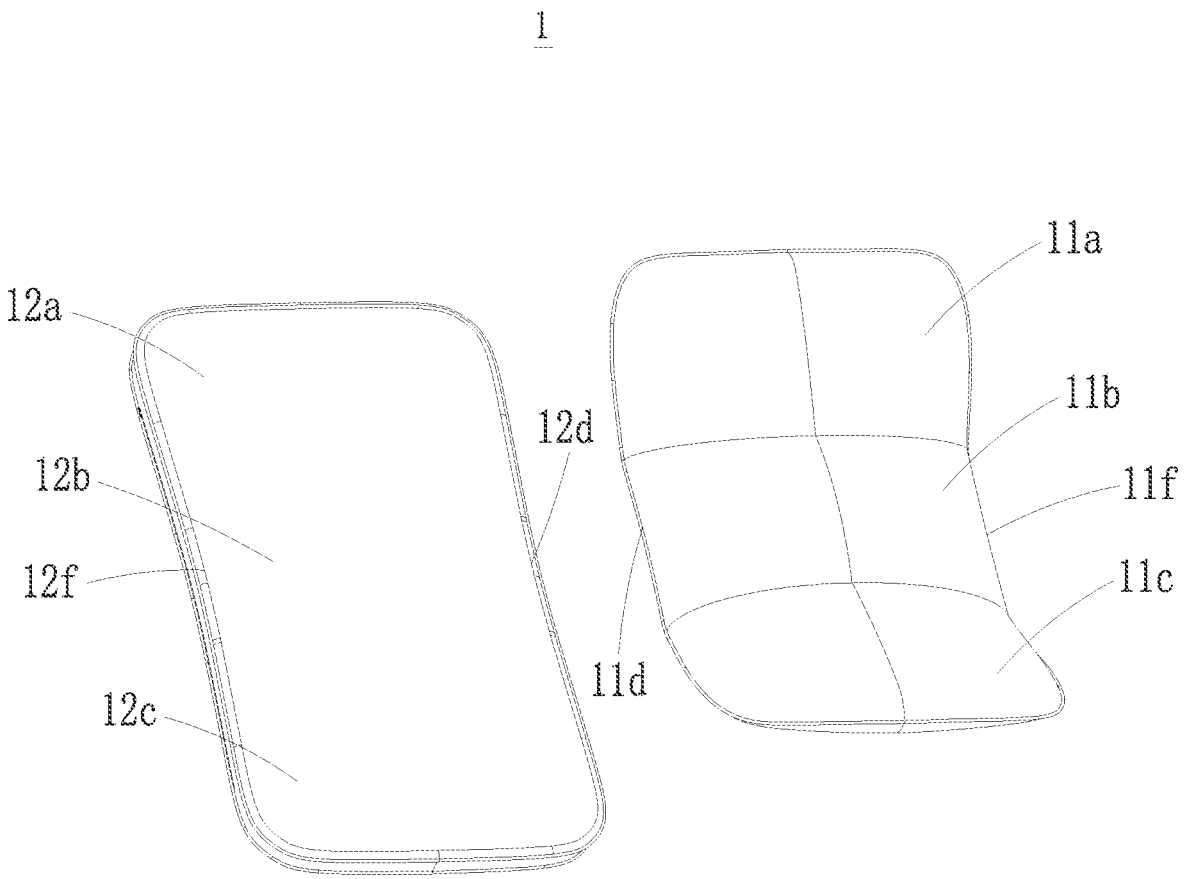
FIG. 3 is a three-dimensional exploded diagram of the pillow shown in FIG. 1.
Figure 4:
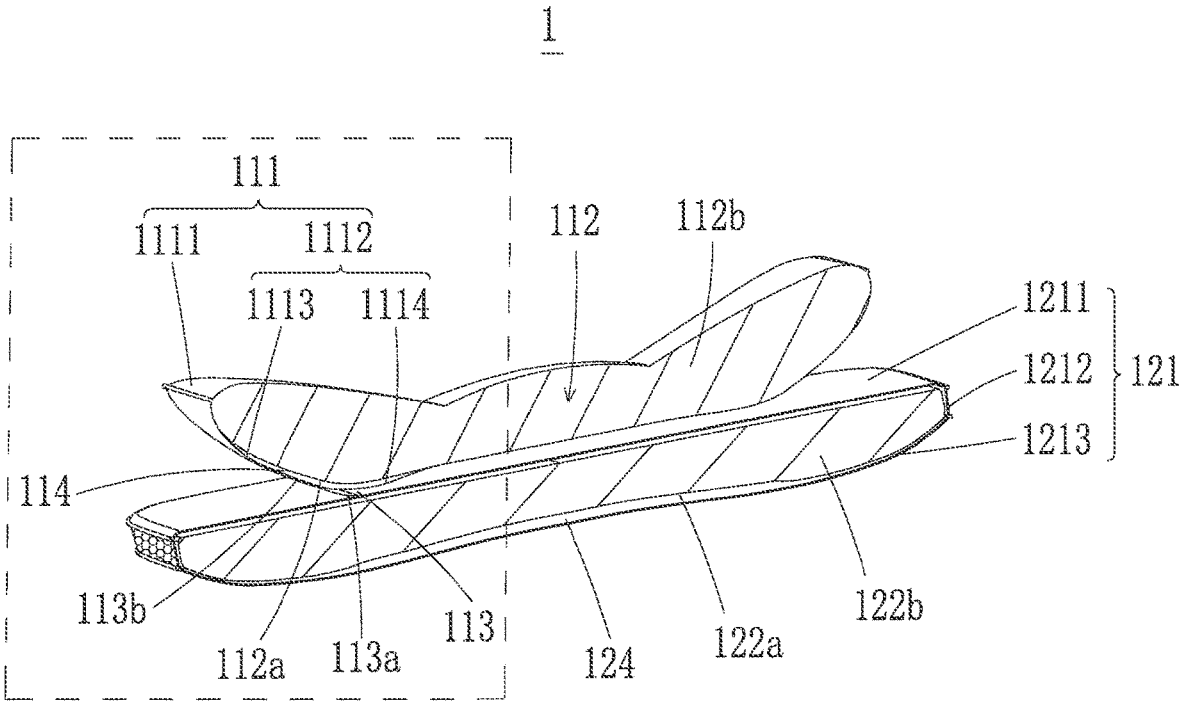
FIG. 4 is a sectional view of the pillow shown in FIG. 1.
Figure 5:
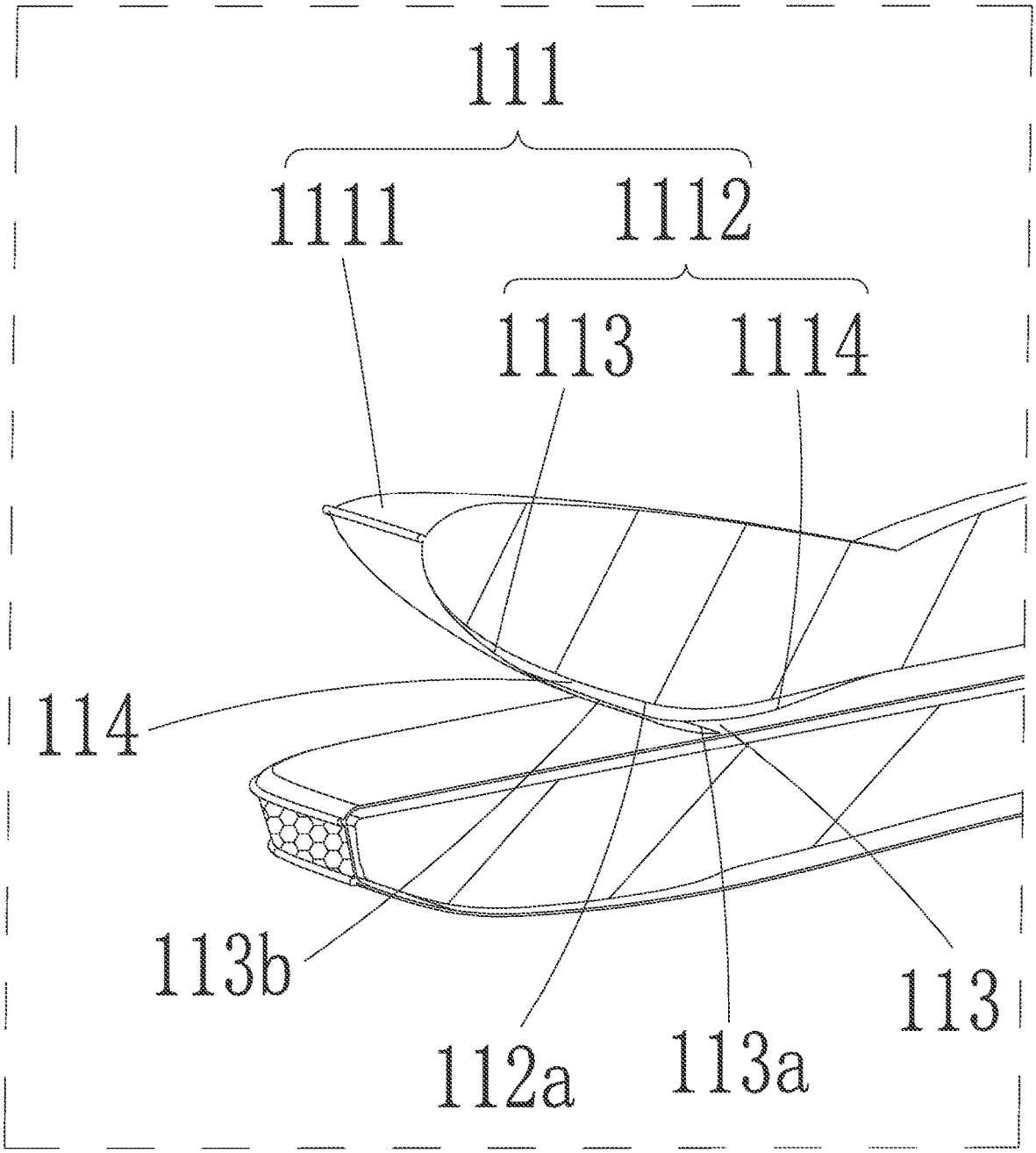
FIG. 5 is a partially enlarged diagram of the sectional view of the pillow shown in FIG. 4.
Figure 6:
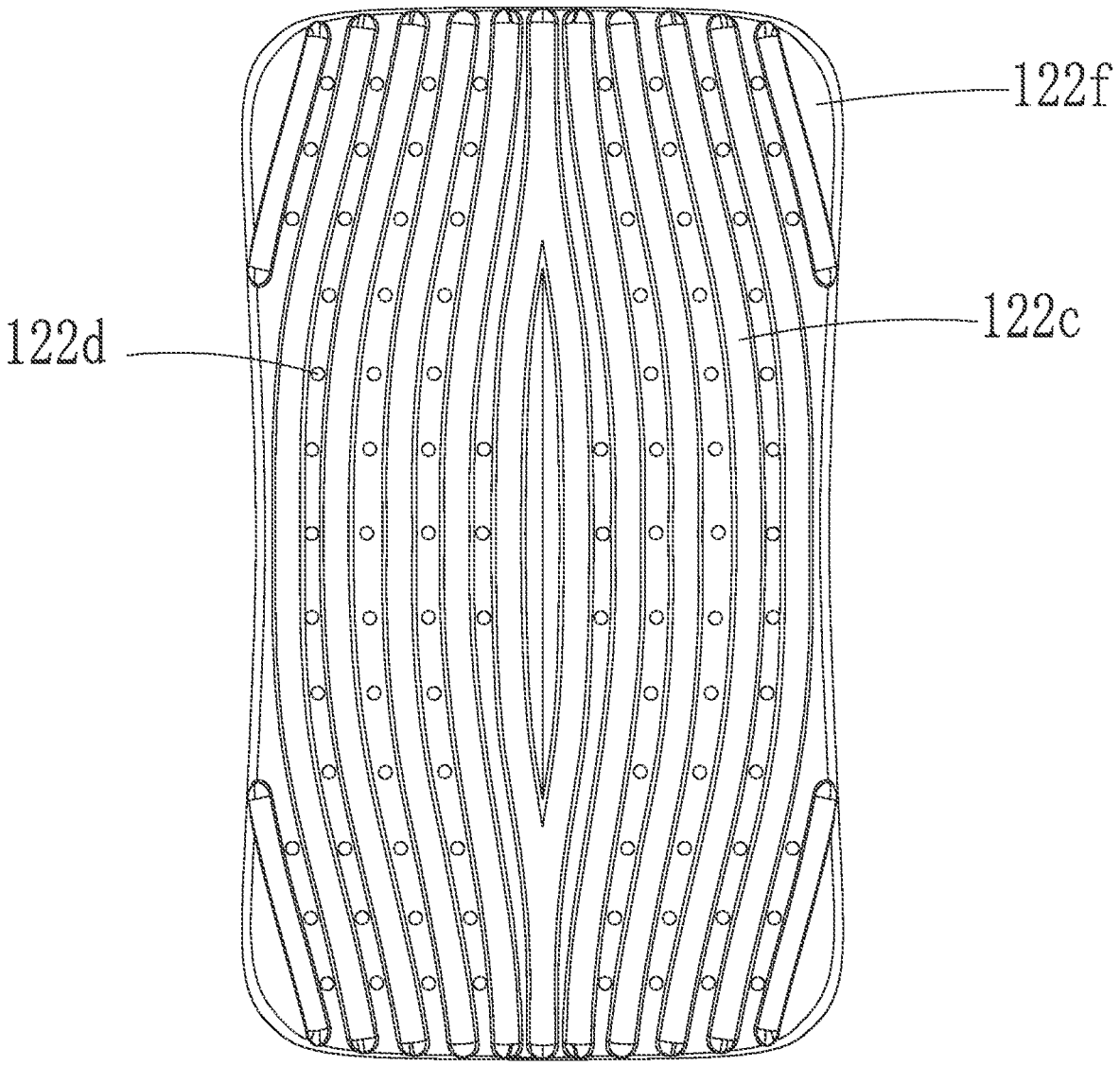
FIG. 6 is a schematic diagram of a three-dimensional structure of a second pillow interior of the present disclosure.

Referring to FIG. 1 to FIG. 6, an embodiment of the present disclosure provides a pillow 1, which includes a first pillow body 11 and a second pillow body 12. The first pillow body 11 is stacked on the second pillow body 12, and the first pillow body 11 and the second pillow body 12 are connected to form a channel 13.

It can be understood that in the pillow 1 of the above embodiment, the pillow 1 is formed by stacking the first pillow body 11 on the second pillow body 12, so that the pillow 1 can be used on both sides: The pillow can be used as a nap pillow or a regular pillow. The first pillow body 11 and the second pillow body 12 are connected to form the channel 13, so that when a user can take a rest on a desk with the pillow 1, the user lets the arms pass through the channel 13. The first pillow body 11 and the second pillow body 12 support the arms above and below the arms, so that a pressure on the arms can be reduced. Meanwhile, the head is placed on the pillow 1, which can improve the sleep experience.

Further, the first pillow body 11 is divided into a first portion 11*a*, a second portion 11*b*, and a third portion 11*c*; the second portion 11*b* is arranged between the first portion 11*a* and the third portion 11*c*; the second pillow body 12 is divided into a fourth portion 12*a*, a fifth portion 12*b*, and a sixth portion 12*c*; the fifth portion 12*b* is arranged between the fourth portion 12*a* and the sixth portion 12*c*; and a first edge 11*d* of the second portion 11*b* is connected to a third edge 12*d* of the fifth portion 12*b*, and a second edge 11*f* of the second portion 11*b* is connected to a fourth edge 12*f* of the fifth portion 12, so as to form the channel 13.

It can be understood that the edges of the first pillow body 11 and the second pillow body 12 are connected, so that a width of the channel 13 can be maximized.

Furthermore, the first pillow body 11 includes a first pillowcase 111, a first pillow interior 112, and a first opening 113; the first pillowcase 111 forms a first cavity 114 by connecting a first face 1111 to a second face 1112; and the first pillow interior 112 is arranged in the first pillowcase 111 through the first opening 113.

It can be understood that the first opening 113 is arranged on the first pillow body 11, so that the first pillow interior 112 can be replaced at any time.

Furthermore, the second face 1112 is composed of a first surface 1113 and a second surface 1114; a fifth edge 113*a* of the first surface 1113 is arranged above or below a sixth edge 113*b* of the second surface 1114 to form the first opening 113.

It can be understood that the first opening 113 is opened, making it easier to replace the first pillow interior 112.

Further, the first pillow interior 112 includes a first pillow interior cover 112*a* and a first filler 112*b*; and the first filler 112*b* is arranged in the first pillow interior cover 112*a*.

It can be understood that the first filler 112*b* can be cotton, down, memory cotton, latex, or the like. The first filler 112*b* is wrapped by the first pillow interior cover 112*a*, so that the first filler 112*b* can be better protected.

Further, the second pillow body 12 includes a second pillowcase 121, a second pillow interior 122, and a second opening 123; the second pillowcase 121 forms a second cavity 124 by an upper side wall 1211, a side wall 1212, and a lower side wall 1213; and the second pillow interior 122 is arranged in the second pillowcase 121 through the second opening 123.

It can be understood that the second opening 123 is arranged to facilitate replacing the second pillow interior 122.

Further, the second opening 123 is arranged at a connection between the upper side wall 1211 and the side wall 1212 of the second pillowcase 121.

It can be understood that the second opening 123 is arranged at the connection between the upper side wall 1211 and the side wall 1212 of the second pillowcase 121, and the second opening 123 is provided with a zipper structure, so that the second opening 123 can be hidden better.

Further, the side wall 1212 is composed of a plurality of uniformly arranged mesh structures 125, and a surface of the lower side wall 1213 is divided into a plurality of uniform rhombic structures 126.

It can be understood that the uniformly arranged mesh structures 125 are arranged on the side wall 1212, which can improve the breathability of the second pillow body 12. The surface of the lower side wall 1213 is divided into the plurality of uniform rhombic structures 126, so that the elasticity of the lower side wall 1213 can be improved. When the second pillow body 12 is used in a manner of facing upwards, the comfort of the pillow 1 can be improved.

Further, the second pillow interior 122 includes a second pillow interior cover 122*a* and a second filler 122*b*; and the second filler 122*b* is arranged in the second pillow interior cover 122*a*.

It can be understood that the second filler 122*b* can be latex, memory cotton, or the like. The second filler 122*b* is wrapped by the second pillow interior cover 122*a*, so that the second filler 122*b* can be better protected.

Further, a plurality of arc-shaped strip protrusions 122*c* are arranged on an upper surface 122*f* of the second filler 122*b*, and a plurality of round holes 122*d* are uniformly arranged on the second filler 122*b*; and the round holes 122*d* penetrate through the second filler 122*b*.

It can be understood that the plurality of arc-shaped strip protrusions 122*c* are arranged on the upper surface 122*f* of the second filler 122*b*, so that during use, an effect of massaging the head can be achieved. The plurality of round holes 122*d* are uniformly arranged on the second filler 122*b*, so that the breathability can be increased.

Further, the first portion 11*a* and the third portion 11*c* of the first pillow body 11 are able to be turned towards the second portion 11*b*. the first portion and the third portion of the first pillow body is able to be turned towards the second portion It can be understood that the first portion 11*a* and the third portion 11*c* can be turned outwards relative to the second portion 11*b*, making it convenient for a user to put the arms into the channel 13.

The various above embodiments are only used to describe the technical solutions of the present disclosure, and not intended to limit the present disclosure. Although the present disclosure has been described in detail with reference to the foregoing embodiments, those ordinarily skilled in the art should understand that they can still modify the technical solutions described in all the foregoing embodiments, or equivalently replace some or all of the technical features, and these modifications or replacements do not depart the essences of the corresponding technical solutions from the spirit and scope of the technical solutions of all the embodiments of the present disclosure.

What is claimed is:

1. A pillow, comprising a first pillow body and a second pillow body, wherein the first pillow body is stacked on the second pillow body; and the first pillow body and the second pillow body are connected to form a channel;

wherein the second pillow body comprises a first pillowcase, a first pillow interior, and a first opening; the first pillowcase forms a first cavity by an upper side wall, a side wall, and a lower side wall; and the first pillow interior is arranged in the first pillowcase through the first opening;

wherein the side wall is composed of a plurality of uniformly arranged mesh structures, and a surface of the lower side wall is divided into a plurality of uniform rhombic structures.

2. The pillow according to claim 1, wherein the first pillow body is divided into a first portion, a second portion, and a third portion; the second portion is arranged between the first portion and the third portion; the second pillow body is divided into a fourth portion, a fifth portion, and a sixth portion; the fifth portion is arranged between the fourth portion and the sixth portion; and a first edge of the second portion is connected to a third edge of the fifth portion, and a second edge of the second portion is connected to a fourth edge of the fifth portion, so as to form the channel.

3. The pillow according to claim 2, wherein the first pillow body comprises a second pillowcase, a second pillow interior, and a second opening; the second pillowcase forms a second cavity by connecting a first face to a second face; and the second pillow interior is arranged in the second pillowcase through the second opening.

4. The pillow according to claim 3, wherein the second face is composed of a first surface and a second surface; a fifth edge of the first surface is arranged above or below a sixth edge of the second surface to form the second opening.

5. The pillow according to claim 4, wherein the second pillow interior comprises a first pillow interior cover and a first filler; and the first filler is arranged in the first pillow interior cover.

6. The pillow according to claim 1, wherein the first opening is arranged at a connection between the upper side wall and the side wall of the first pillowcase.

7. The pillow according to claim 1, wherein the first pillow interior comprises a second pillow interior cover and a second filler; and the second filler is arranged in the second pillow interior cover.

8. The pillow according to claim 7, wherein a plurality of arc-shaped strip protrusions are arranged on an upper surface of the second filler, and a plurality of round holes are uniformly arranged on the second filler; and the round holes penetrate through the second filler.

9. The pillow according to claim 2, wherein the first portion and the third portion of the first pillow body are able to be turned towards the second portion.

10. A pillow, comprising a first pillow body and a second pillow body, wherein the first pillow body is stacked on the second pillow body; two sides of the first pillow body and two sides of the second pillow body are connected to form a channel between the first pillow body and the second pillow body;

wherein the second pillow body comprises a first pillowcase, a first pillow interior, and a first opening; the first pillowcase forms a first cavity by an upper side wall, a side wall, and a lower side wall; and the first pillow interior is arranged in the first pillowcase through the first opening;

wherein the first pillow interior comprises a first pillow interior cover and a first filler; and the first filler is arranged in the first pillow interior cover;

wherein a plurality of arc-shaped strip protrusions are arranged on an upper surface of the first filler, and a plurality of holes are uniformly arranged on the first filler; and the holes penetrate through the first filler.

11. The pillow according to claim 10, wherein the first pillow body is divided into a first portion, a second portion, and a third portion; the second portion is arranged between the first portion and the third portion; the second pillow body is divided into a fourth portion, a fifth portion, and a sixth portion; the fifth portion is arranged between the fourth portion and the sixth portion; and a first edge of the second portion is connected to a third edge of the fifth portion, and a second edge of the second portion is connected to a fourth edge of the fifth portion, so as to form the channel.

12. The pillow according to claim 11, wherein the first pillow body comprises a second pillowcase, a second pillow interior, and a second opening; the second pillowcase forms a second cavity by connecting a first face to a second face;

and the second pillow interior is arranged in the second pillowcase through the second opening.

13. The pillow according to claim 12, wherein the second face is composed of a first surface and a second surface; a fifth edge of the first surface is arranged above or below a sixth edge of the second surface to form the second opening; wherein the second pillow interior comprises a second pillow interior cover and a second filler; and the second filler is arranged in the second pillow interior cover.

14. The pillow according to claim 10, wherein the first opening is arranged at a connection between the upper side wall and the side wall of the first pillowcase; wherein the side wall is composed of a plurality of uniformly arranged mesh structures, and a surface of the lower side wall is divided into a plurality of uniform rhombic structures.

15. The pillow according to claim 11, wherein the first portion and the third portion of the first pillow body are able to be turned towards the second portion.

* * * * *